US008722575B2

(12) United States Patent
Masciambruni

(10) Patent No.: US 8,722,575 B2
(45) Date of Patent: May 13, 2014

(54) PACKAGING MATERIAL WITH A COLOURED ELEMENT WHICH AT A PREDETERMINED TEMPERATURE DISCOLOURS PARTIALLY, REVEALING A MARKING, AND METHOD FOR PRODUCING THIS MATERIAL

(75) Inventor: Roberto Masciambruni, Pescara (IT)

(73) Assignee: Aziende Chimiche Riunite Angelini Francesco A.C.R.A.F. S.p.A., Rome (IT)

( * ) Notice: Subject to any disclaimer, the term of this patent is extended or adjusted under 35 U.S.C. 154(b) by 160 days.

(21) Appl. No.: 13/127,107

(22) PCT Filed: Nov. 13, 2009

(86) PCT No.: PCT/EP2009/065108

§ 371 (c)(1),
(2), (4) Date: Jun. 30, 2011

(87) PCT Pub. No.: WO2010/060812

PCT Pub. Date: Jun. 3, 2010

(65) Prior Publication Data

US 2011/0253577 A1 Oct. 20, 2011

(30) Foreign Application Priority Data

Nov. 25, 2008 (EP) ..... 08425749

(51) Int. Cl.

| | |
|---|---|
| ***B41M 3/00*** | (2006.01) |
| ***B41M 3/14*** | (2006.01) |
| ***B41M 5/30*** | (2006.01) |
| ***A61J 1/18*** | (2006.01) |
| ***B05D 1/36*** | (2006.01) |
| ***B65D 1/36*** | (2006.01) |

(52) U.S. Cl.
USPC ..... 503/206; 206/459.1; 427/258

(58) Field of Classification Search
CPC ..... A61J 1/18; B05D 1/36; B65D 79/02; G01N 31/229; G09F 3/0291; B41M 3/005; B41M 3/30; B41M 5/30
USPC ..... 503/200–226; 427/258
See application file for complete search history.

(56) References Cited

U.S. PATENT DOCUMENTS

| | | | |
|---|---|---|---|
| 4,385,844 | A | 5/1983 | Fergason |
| 5,591,255 | A | 1/1997 | Small et al. |
| 5,997,849 | A | 12/1999 | Small et al. |
| 6,620,764 | B1 | 9/2003 | Maruyama |
| 2004/0142070 | A1 | 7/2004 | Haen |
| 2006/0232059 | A1 | 10/2006 | Fortune et al. |
| 2006/0249949 | A1 | 11/2006 | Fortune |

FOREIGN PATENT DOCUMENTS

| | | |
|---|---|---|
| GB | 2 387 951 | 10/2003 |
| WO | 03 103983 | 12/2003 |
| WO | 2007 115662 | 10/2007 |

OTHER PUBLICATIONS

International Search Report issued Feb. 15, 2010 in PCT/EP09/065108 filed Nov. 13, 2009.

U.S. Appl. No. 13/127,870, filed May 25, 2011, Masciambruni.

*Primary Examiner* — Bruce H Hess

(74) *Attorney, Agent, or Firm* — Oblon, Spivak, McClelland, Maier & Neustadt, L.L.P.

(57) ABSTRACT

It is disclosed a packaging material (1) for a pharmaceutical product. The packaging material comprises a colored element (2) which at a predetermined temperature, below which the pharmaceutical product must be kept, discolors partially, revealing a marking. The element is formed by a first portion forming the marking (2') printed with conventional ink, and a second portion (2") printed with thermochromic ink. The thermochromic ink is colored below the predetermined temperature and becomes colorless when this predetermined temperature is reached or exceeded. The two portions are arranged so that the first portion is invisible below the predetermined temperature, but becomes visible when this temperature is reached or exceeded.

4 Claims, 2 Drawing Sheets

PACKAGING MATERIAL WITH A COLOURED ELEMENT WHICH AT A PREDETERMINED TEMPERATURE DISCOLOURS PARTIALLY, REVEALING A MARKING, AND METHOD FOR PRODUCING THIS MATERIAL

TECHNICAL FIELD

The present invention relates to a packaging material for a pharmaceutical product, and to a method for producing said packaging material.

BACKGROUND ART

The existence of substances able to change colour at a predetermined temperature is known. Said substances are referred to as being "thermochromic". Generally, said substances form part of the category of liquid crystals.

During the last few decades numerous inks based on thermochromic substances have been investigated. These inks are called "thermochromic inks" and are used for silk-screen printing, flexographic printing, wet offset printing, lithographic printing and the like.

Some of these inks are coloured and change colour at a predetermined temperature. Other thermochromic inks are colourless and become coloured at a predetermined temperature. There are also other inks which are coloured and become colourless at a predetermined temperature.

SUMMARY OF THE INVENTION

During the course of the present description and in the claims the expression:

"packaging material" is used to indicate any container, any label or any tag suitable for packaging or identifying a pharmaceutical product. The expression "packaging material" is used here to indicate also any other type of material which accompanies a pharmaceutical product as presented and sold to the public. Typical containers according to the present invention are cases, boxes, medicinal bottles, phials, blister packs, sachets, tubes for cream or paste-like materials, bags, bottles, films, sheets of paper, trays, cans and the like;

"marking" is used to indicate any design, figure, letter of the alphabet, word, number, symbol, logo and any combination thereof. Typically, this marking indicates to the operator and/or the user, a piece of information, a warning, a message or an alarm condition;

"at a predetermined temperature" indicates a temperature range. In fact, in the thermochromic inks known hitherto, the transition or change-over from one colour to another or from a coloured state to a colourless state and vice versa occurs within a given temperature range. For example, a "predetermined temperature" of 25° C. indicates, generally, a range of 25°±2° C., preferably 25°±1° C., or even more preferably 25°±0.5° C. Similarly, a "predetermined temperature" of 10° C. indicates, generally, a range of 10° C.±2° C., preferably 10°±1° C., or even more preferably 10°±0.5° C., and so on;

"visible" is used to indicate that a marking can be clearly distinguished by the human eye when viewed by a normally attentive person. On the other hand, the term "invisible" is used to indicate that a marking cannot be clearly distinguished by the human eye when viewed by a normally attentive person;

"conventional ink" is used to indicate an ink which, in a temperature range of between −20° C. and 60° C., does not undergo changes in colour which are visible to the human eye when viewed by a normally attentive person and which does not change from a colourless state to a coloured state or vice versa.

The inventor has noticed that hitherto the technology of thermochromic inks has not been widely adopted in connection with pharmaceutical products, because it has a number of disadvantages of varying gravity depending on the characteristics of the thermochromic ink used.

For example, in the case where it is required to inform the operator or user that the temperature of a pharmaceutical product has reached its maximum limit of 25° C., the marking "25° C." will be printed on a packaging material.

When this marking is formed by an ink of the type which changes colour upon reaching the limit temperature, there is the drawback that the marking is visible at any temperature and, therefore, the user must memorise the meaning of the various colours. For example, in the case where a first manufacturer uses an ink which changes from yellow to green at 25° C., the user has to remember that the colour green indicates that the temperature of 25° C. has been reached. Should a second manufacturer use a different type of ink, for example one which changes from green to red at 25° C., the user has to remember that in this case the colour green indicates that the temperature of 25° C. has not been reached, while in the first case it indicated that the temperature had been reached. Obviously, the situation will be all the more confusing, the greater the number of manufacturers using these types of inks.

Moreover, the inventor realised that, in turn, an ink which is colourless below 25° C. and becomes coloured when it reaches said temperature has the drawback that the marking is invisible below the limit temperature such that the user has to check very carefully the entire packaging material in order to establish the presence and location of the marking indicating that the limit temperature has been reached and/or exceeded. Disadvantageously, this operation may be very complex and may give rise to many errors.

Finally, the inventor has noticed that disadvantageously an ink which is coloured below 25° C. and becomes colourless when it reaches the aforementioned temperature is practically impossible to use because a normally attentive user tends not to notice the disappearance of the marking, especially if it is some time since the user has previously looked at the pharmaceutical product.

Accordingly, the inventor has addressed the problem of providing a packaging material for a pharmaceutical product which overcomes the aforesaid drawbacks.

In particular, the inventor has addressed the problem of providing a packaging material for a pharmaceutical product able to inform an operator or a user that the temperature of a pharmaceutical product has reached its maximum limit in such a way that a normally attentive user easily recognises that this maximum limit is reached.

According to a first aspect thereof, the present invention relates, therefore, to a packaging material for a pharmaceutical product, the packaging material having a coloured element which, at a predetermined temperature below which the pharmaceutical product must be kept, discolours partially, revealing a marking, wherein:

(a) the element is formed by a first portion, which forms the marking printed with a conventional ink, and by a second portion printed with a thermochromic ink;

(b) the thermochromic ink is coloured below the predetermined temperature and becomes colourless when the predetermined temperature is reached or exceeded; and (c) the first portion and second portion are arranged so that the first portion is substantially invisible below the predetermined temperature, but becomes visible when the predetermined temperature is reached or exceeded.

The abovementioned expression "discolours partially" with reference to the abovementioned coloured element is intended to mean that only the first portion, and not the second portion, discolours.

Preferably, said thermochromic ink is of the reversible type. In other words, it returns to the coloured state when the temperature falls below the predetermined temperature.

In a first preferred embodiment of the packaging material according to the present invention, the second portion is superimposed on the first portion.

In a second preferred embodiment of the packaging material according to the present invention, the first portion and second portion of the coloured element are situated alongside each other.

Preferably, when the first portion has spaces without conventional ink, the second portion of the coloured element also covers the spaces.

Preferably, in this second embodiment, the colour of the thermochromic ink is, below the predetermined temperature, quite similar to that of the conventional ink.

Even more preferably, the colour of the thermochromic ink is, below the predetermined temperature, as similar as possible to that of the conventional ink.

According to a second aspect thereof, the present invention relates to a method for producing a packaging material for a pharmaceutical product, the packaging material having a coloured element which at a predetermined temperature, below which the pharmaceutical product must be kept, discolours partially, revealing a marking, the production of the coloured element comprising the following steps:

a) obtaining a packaging material;

b) printing the marking thereon using an ink of the conventional type;

c) applying a thermochromic ink, which is coloured below the temperature, but becomes colourless when the predetermined temperature is reached or exceeded, so that the marking is substantially invisible below the predetermined temperature, but becomes visible when the predetermined temperature is reached or exceeded.

Preferably the thermochromic ink is of the reversible type. In other words, it returns to the coloured state when the temperature falls below the predetermined temperature.

In a first preferred embodiment of the method according to the present invention, the thermochromic ink forms a layer superimposed on the marking.

In a second preferred embodiment of the method according to the present invention, the thermochromic ink is applied so as to form a layer which is situated alongside the marking.

Preferably, when the first portion has spaces without conventional ink, the spaces are also covered by a layer of thermochromic ink.

Preferably, in this second embodiment, the colour of the thermochromic ink is, below the predetermined temperature, quite similar to that of the conventional ink with which the marking has been printed.

Even more preferably, the colour of the thermochromic ink is, below the predetermined temperature, as similar as possible to that of the conventional ink with which the marking has been printed.

BRIEF DESCRIPTION OF THE DRAWINGS

The present invention will now be further illustrated with reference to the accompanying drawings provided by way of a non-limiting example in which.

DETAILED DESCRIPTION OF PREFERRED EMBODIMENTS OF THE INVENTION

Figure 1:
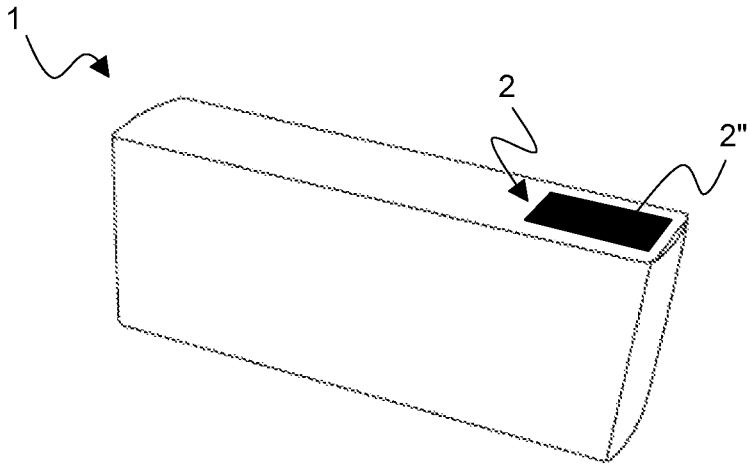
FIG. 1 is a schematic perspective view of a packaging material, according to a first preferred embodiment of the present invention, in which the temperature of said material is lower than the temperature at which the thermochromic ink changes from a coloured to colourless state.
Figure 2:
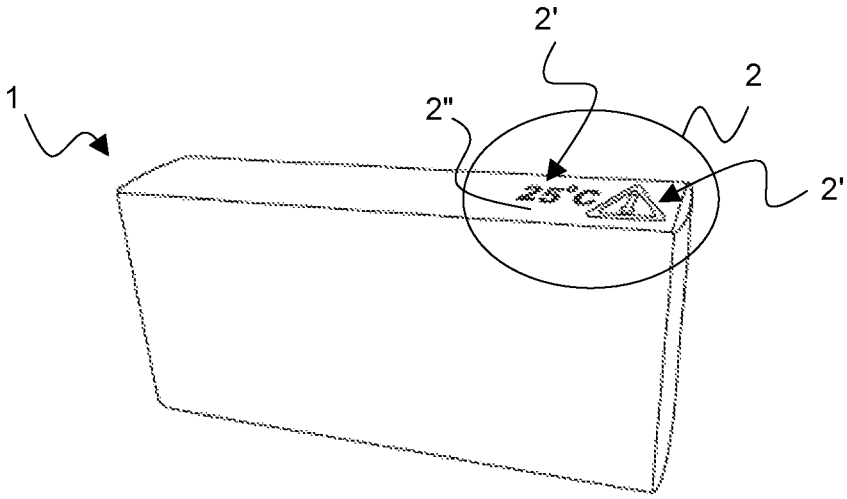
FIG. 2 is a schematic perspective view of the packaging material according to FIG. 1 in which the temperature of said material has reached or exceeded the temperature at which the thermochromic ink changes from a coloured to a colourless state.

FIGS. 1 and 2 show a packaging material 1 according to a first preferred embodiment of the present invention. The packaging material 1 is a parallelepiped-shaped box. As already stated, this is not limiting, in that the packaging material may be a label, tag, phial, sachet, blister pack, medicinal bottle, case, tube for cream or paste-like material, bag, bottle, film, sheet, tray, can, or any other packaging material commonly used in the sector of pharmaceutical products. As already stated, the expression "packaging material" is used here to indicate also any other type of material which accompanies a pharmaceutical product as presented and sold to the public.

According to the present invention, a coloured element 2 is associated with the packaging material 1. This coloured element 2 is arranged, for example, on an outer surface of the packaging material 1, preferably in a position which can be easily seen by an operator or a user.

This coloured element 2 comprises a conventional red ink and a thermochromic ink which changes from red to a colourless state at a predetermined temperature of 25° C.±0.5° C. The change of colour of said thermochromic ink is reversible since its colour becomes red again when the temperature falls below said predetermined temperature.

More particularly, said conventional ink forms a marking 2' consisting of a logo and the 25° C. symbol (FIG. 2) and said thermochromic ink forms a layer 2" superimposed on the marking 2'.

When the temperature of the packaging material 1 is less than said predetermined temperature, the colour of the layer 2" renders invisible the marking 2' (FIG. 1).

However, when the temperature of the packaging material 1 is equal to, or greater than, said predetermined temperature the layer 2" of said thermochromic ink becomes colourless and renders visible said marking 2' (FIG. 2).

The packaging material 1 according to FIGS. 1 and 2 is particularly advantageous for a pharmaceutical product, which must be kept at a temperature below 25° C.

In fact, it allows an operator or a user to know whether the pharmaceutical product is kept at a suitable temperature or whether it must be moved into a cooler environment.

Although this first preferred embodiment of the invention has been illustrated in connection with a pharmaceutical product which must be kept below 25° C., the person skilled in the art will immediately realise that it can be used to produce any packaging material for a pharmaceutical product which must be kept below a predetermined temperature such as, for example, −5°, 0°, 5°, 10°, 15°, 27° and 30° C., provided that a suitable thermochromic ink which changes from a coloured to a colourless state at said predetermined temperature is used.

Figure 3:
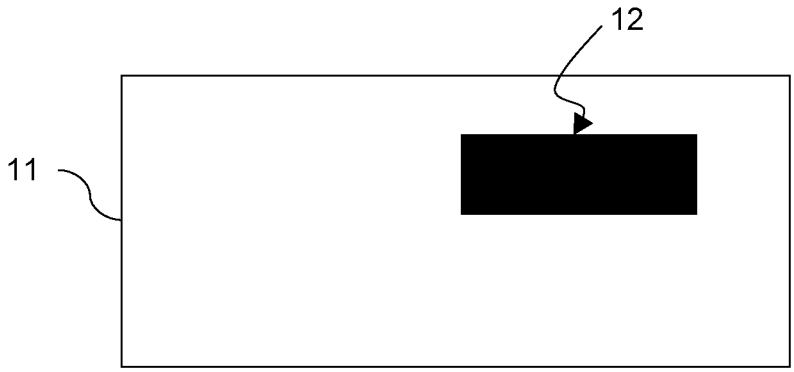
FIG. 3 is a front view of a packaging material, according to a second preferred embodiment of the present invention, in which the temperature of said material is lower than the temperature at which the thermochromic ink changes from a coloured to a colourless state.
Figure 4:
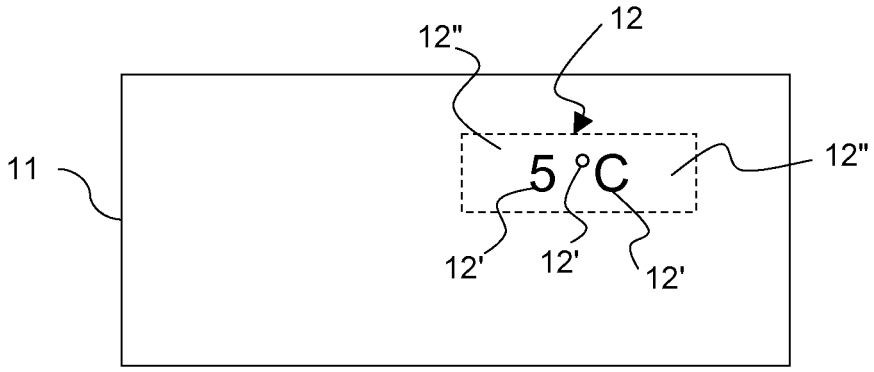
FIG. 4 is a front view of the packaging material according to FIG. 3, in which the temperature of said material has reached or exceeded the temperature at which the thermochromic ink changes from a coloured to a colourless state.

FIGS. 3 and 4 show a packaging material 11 according to a second preferred embodiment of the present invention. The packaging material 11 is a label. As already mentioned, this is not limiting in that the packaging material may be a box, tag, phial, sachet, blister pack, medicinal bottle, case, tube for cream or paste-like material, bag, bottle, film, sheet, tray, can or any other packaging material commonly used in the sector of pharmaceutical products. As already stated, the expression "packaging material" is used here to indicate also any other type of material which accompanies a pharmaceutical product as presented and sold to the public.

According to the present invention, a coloured element 12 is associated with the packaging material 11.

This coloured element 12 comprises a conventional black ink and a thermochromic ink which changes from black to a colourless state at a predetermined temperature of 5° C.±0.5° C. The change in colour of said thermochromic ink is reversible since its colour becomes black again when the temperature falls below said predetermined temperature.

More particularly, said conventional ink forms a marking 12' consisting of the symbol 5° C. (FIG. 4). In turn said thermochromic ink forms a layer 12" which surrounds and is situated alongside the marking 12' so as to form the coloured element 12 where the marking 12' is invisible as long as the temperature of the packaging material 1 is less than said predetermined temperature (FIG. 3).

On the other hand, when the temperature of the packaging material 11 is equal to or greater than said predetermined temperature, the layer 12" of said thermochromic ink becomes colourless and renders visible said marking 12' (FIG. 4).

The packaging material 11 according to FIGS. 3 and 4 is particularly advantageous for a pharmaceutical product which must be kept below 5° C.

In this case also, although this second preferred embodiment of the invention has been illustrated in connection with a pharmaceutical product which must be kept below 5° C., the person skilled in the art will immediately realise that it can be used to produce any packaging material for a pharmaceutical product which must be kept below a predetermined temperature such as, for example, −5°, 0°, 10°, 15°, 25°, 27° and 30° C., provided that a suitable thermochromic ink which changes from a coloured to a colourless state at said predetermined temperature is used.

Examples of suitable thermochromic inks according to the present invention are those described in U.S. Pat. No. 4,385,844.

Other suitable thermochromic inks according to the present invention are the offset inks DYNACOLOR™ produced by the company C.T.I (Chromatic Technologies Incorporated), Colorado Springs, U.S.A. A wide range of DYNACOLOR™ offset thermochromic inks, which each have a corresponding predetermined temperature for changing from the coloured state to the colourless state, are commercially available.

Depending on the ink selected, said predetermined temperature ranges from −5° C. to 65° C. The change in colour is reversible since they return to the coloured state when the temperature falls below said predetermined temperature. The DYNACOLOR™ offset thermochromic inks are described by the patents U.S. Pat. Nos. 5,591,255 and 5,997,849.

Other suitable thermochromic inks according to the present invention are the inks produced by the company SICPA SA, Prilly, Switzerland.

The preferred printing techniques according to the present invention are silk-screen printing and flexographic printing. The inventor has found that these printing techniques, among all the possible printing techniques, are particularly suitable for producing the above packages on industrial scale, since they are very efficient and they do not comprise any manual step. Further, the above selected printing techniques are particularly suitable for printing small images with high definition, such as for instance images including elements with size lower than 10 points.

The invention claimed is:

1. A packaging material comprising a colored element, which at a predetermined temperature below which the pharmaceutical product must be kept, discolors partially, revealing a marking, wherein:

(a) the colored element comprises a first portion, which forms the marking printed with a conventional ink, and a second portion printed with a thermochromic ink;

(b) the thermochromic ink is colored below the predetermined temperature and becomes colorless when the predetermined temperature is reached or exceeded;

(c) the first portion and second portion are arranged so that the first portion is substantially invisible below the predetermined temperature, but becomes visible when the predetermined temperature is reached or exceeded, (d) the first portion and second portion of the colored element are situated alongside each other, and (e) the packaging material is suitable for a pharmaceutical product, wherein the color of the thermochromic ink is, below the predetermined temperature, as similar as possible to that of the conventional ink, and when the first portion has spaces without the conventional ink, the second portion of the colored element also covers the spaces without the conventional ink.

2. The packaging material of claim 1, wherein the thermochromic ink is reversible.

3. A method for producing a packaging material for a pharmaceutical product, comprising:

(a) printing a marking on a packaging material with a conventional ink;

(b) applying a thermochromic ink to the packaging material, which is colored below a predetermined temperature below which the pharmaceutical product must be kept, but becomes colorless when the predetermined temperature is reached or exceeded, so that the marking is substantially invisible below the predetermined temperature, but becomes visible when the predetermined temperature is reached or exceeded, to give the packaging material comprising a colored element which at the predetermined temperature, discolors partially, revealing the marking; and (c) wherein the thermochromic ink is applied so as to form a layer which is situated alongside the marking, wherein the color of the thermochromic ink is, below the predetermined temperature, as similar as possible to that of the conventional ink with which the marking has been printed, and when the first portion has spaces without the conventional ink, the second portion of the colored element also covers the spaces without the conventional ink.

4. The method of claim 3, wherein the thermochromic ink is reversible.

* * * * *